US009700091B2

(12) United States Patent
Parsons

(10) Patent No.: US 9,700,091 B2
(45) Date of Patent: Jul. 11, 2017

(54) KEY HOLDER IN BELT

(75) Inventor: Kevin L. Parsons, Appleton, WI (US)

(73) Assignee: Armament Systems and Procedures, Inc., Appleton, WI (US)

( * ) Notice: Subject to any disclaimer, the term of this patent is extended or adjusted under 35 U.S.C. 154(b) by 871 days.

(21) Appl. No.: 13/494,117

(22) Filed: Jun. 12, 2012

(65) Prior Publication Data

US 2013/0326797 A1 Dec. 12, 2013

(51) Int. Cl.

| | |
|---|---|
| ***A41F 9/00*** | (2006.01) |
| ***A45F 5/02*** | (2006.01) |
| *A44B 15/00* | (2006.01) |

(52) U.S. Cl.

CPC ..... *A41F 9/002* (2013.01); *A45F 5/021* (2013.01); *A45F 5/022* (2013.01); *A44B 15/00* (2013.01); *A45F 2200/0558* (2013.01)

(58) Field of Classification Search

USPC ..... 224/578; 2/300, 322, 338

See application file for complete search history.

(56) References Cited

U.S. PATENT DOCUMENTS

| | | | | | |
|---|---|---|---|---|---|
| 842,037 | A | * | 1/1907 | Wallerstedt | 206/0.83 |
| 1,486,470 | A | * | 3/1924 | Welch | 224/683 |
| 1,614,246 | A | * | 1/1927 | Lederer | 24/265 WS |
| 2,004,412 | A | * | 6/1935 | Luftig | 224/587 |
| 2,004,477 | A | * | 6/1935 | Mather | 224/587 |
| 2,048,498 | A | * | 7/1936 | Foster | 224/587 |
| 2,156,373 | A | * | 5/1939 | Craighead | 224/587 |
| 2,339,297 | A | * | 1/1944 | Segal | 224/163 |
| 2,481,787 | A | * | 9/1949 | Segal | 224/152 |
| 2,503,157 | A | * | 4/1950 | Knee | 224/587 |
| 2,714,479 | A | * | 8/1955 | Zeitzew | 224/673 |
| 2,827,214 | A | * | 3/1958 | Lutz | 224/587 |
| 2,859,789 | A | * | 11/1958 | Buckett | 206/37.4 |
| 3,129,862 | A | * | 4/1964 | Cone | 224/587 |
| 3,144,935 | A | * | 8/1964 | Geyler | 70/456 R |
| 3,529,649 | A | * | 9/1970 | Bennett | 206/37.1 |
| 3,931,917 | A | * | 1/1976 | Zellmer | 224/602 |
| 4,037,716 | A | * | 7/1977 | Marks | 206/38 |
| 4,062,066 | A | * | 12/1977 | Weiss | 2/322 |
| 4,139,133 | A | * | 2/1979 | Repka | 224/587 |
| 4,521,939 | A | * | 6/1985 | Chabot et al. | 24/188 |
| 4,905,878 | A | * | 3/1990 | Lovinger et al. | 224/163 |
| 5,341,972 | A | * | 8/1994 | Jacks | 224/165 |
| D351,366 | S | * | 10/1994 | Park | D11/231 |
| 6,067,661 | A | * | 5/2000 | Bates | 2/338 |
| 7,480,967 | B2 | * | 1/2009 | Kojoori et al. | 24/163 R |

* cited by examiner

*Primary Examiner* — Richale Quinn

(74) *Attorney, Agent, or Firm* — Hahn Loeser & Parks, LLP

(57) ABSTRACT

A belt is provided having a longitudinal axis configured to encompass the waist of a person, a patch is disposed on the belt, the patch extends across a width of the belt and forms a longitudinal pocket for a key between the patch and belt where an opening of the pocket receives the actuator end of the key, the longitudinal pocket is oriented to receive the key parallel to the longitudinal axis of the belt and a cutout in the patch extends outwards from the opening and from the pocket along the longitudinal axis, the cutout traces the outline of the handle of the key wherein a curvature of the belt causes the portion of the patch surrounding the opening to pull the handle of the key into the cutout against the belt thereby preventing the key from being accidentally dislodged.

16 Claims, 1 Drawing Sheet

KEY HOLDER IN BELT

FIELD

The field of the invention relates to belts and more particularly to a belt that has a receptacle for a key.

BACKGROUND

Belts for use by persons for securing personal items to the person are generally known. In their simplest form, a belt may be placed around the waist of the wearer and be used to hold up the pants of the wearer.

In other forms, a belt may be modified to carrying other materials. For example, a series of loops may be provided on an outer surface of the belt and the belt may be used by the military to carry ammunition. In this case, the modified belt may be worn around the waist of the user or over the shoulder.

In other cases, a holster for a handgun may be attached to a belt in a location directly below either the right or left arm of a wearer. In this case, the belt may or may not also include loops on the outer surface to carry ammunition for the handgun.

In the case of the police, belts may be further modified to carry other required equipment. Examples include handcuffs, baton, flashlight, etc. In the case of a holster for handcuffs, batons or flashlight, the holster may be permanently attached (e.g., sewing, rivets, etc.) or provided with a metal clasp the slides over a top edge of the belt and grips the belt from both sides.

In case of a belt with a receptacle for handcuffs, the user must also carry a handcuff key. While a handcuff holster could also have a pocket for the key, the key is usually carried in the clothing of the user because an exposed or visible key may be retrieved by a prisoner during a struggle or secretly without knowledge of the custodian of the prisoner, thereby potentially resulting in the release of the handcuffs and danger of attack on the custodian.

While current practices of securing prisoners with handcuffs works well, handcuff keys can be lost either during a struggle with a prisoner or because the user cannot remember where he/she placed the key. Accordingly, better methods are needed for the control of handcuff keys.

DETAIL DESCRIPTION OF AN ILLUSTRATED EMBODIMENT

Figure 1:
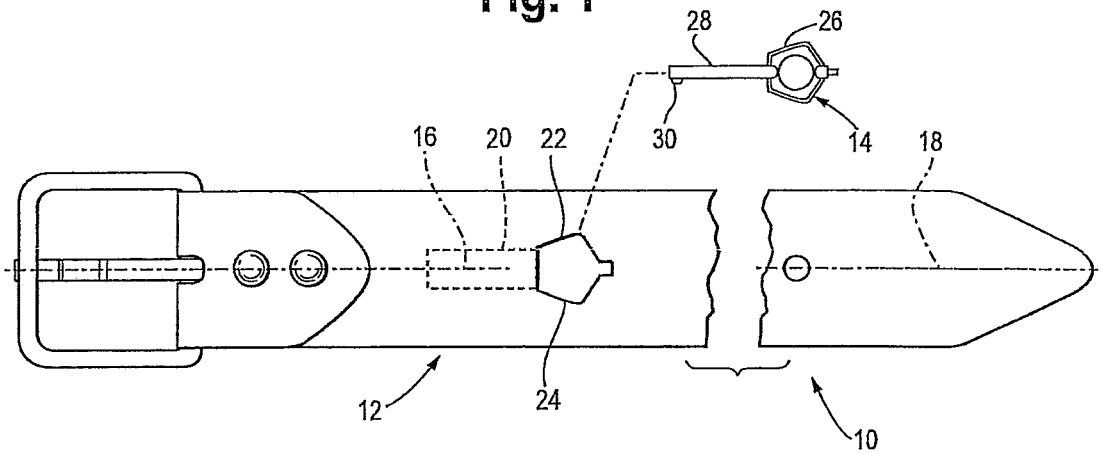
FIG. 1 is a rear view of a belt with a receptacle for a key shown generally in accordance with an illustrated embodiment.

FIG. 1 depicts a simplified rear view of a belt 10 having a receptacle 12 for a handcuff key 14 shown generally in accordance with an illustrated embodiment. Under the illustrated embodiment, the receptacle 12 has a longitudinal axis 16 that is parallel with a longitudinal axis 18 of the belt 10. The axis 16, 18 may be coincident in most instances.

The receptacle 12 includes a pocket 20 and a cutout 22. As with the receptacle 12, in general, the longitudinal axis 16 of the pocket 20 is parallel with the longitudinal axis 18 of the belt.

The pocket 20 (in the direction of longitudinal axis 16) has a closed end on one end and an opening 24 on the other, opposing end. The opening 24 of the pocket 20 opens into the cutout 22.

The cutout 22 has out an outline that is only slightly larger (e.g., a few millimeters) than the head 26 of the key 14, but that otherwise matches the outside contours of the head 26 of the key 14. The cutout 22 is a recessed area in the surface of the belt 10 comprising a second pocket that receives the head 26 of the key so the head 26 of the key 14 is also recessed below the surface of the belt 10 when the key 14 is placed into the receptacle 12.

Figure 2:
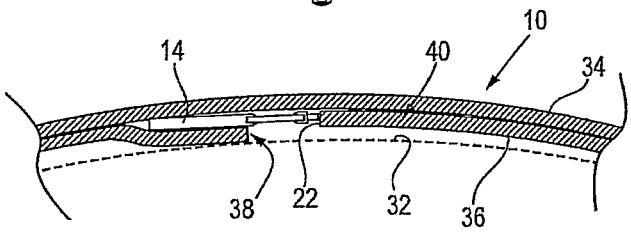
FIG. 2 is a side view of the belt of FIG. 1 in the context of use with a person.

In use, the receptacle 12 is provided with a set of dimensions and is otherwise adapted to receive the handcuff key 14. FIG. 2 is a simplified view of the belt 10 shown around the waist 32 of a person. As shown in FIG. 2, the belt 10 may have an inner layer 36 and an outer layer 34. The inner layer 36 of the belt 10 is placed against the waist 32 of the person during use. The pocket 20 is formed between the inner layer 36 and outer layer 34.

In use (and as shown in FIG. 2), the belt 10 is curved to conform to the circular nature of the waist of the person while the key 14 retains its straight shape. Because of the curvature of the belt 10, the portion of the inner layer 36 around the opening 24 exerts a force 38 on the shaft 28 of the key 14 adjacent the head 26. The force 38 urges the head 26 of the key 14 into the cutout 22. Since the head 26 of the key 14 is surrounded by the walls of the cutout 22, the key 14 is prevented from moving longitudinally within the receptacle 12. Since the key 14 is prevented from longitudinal movement, the key cannot be accidentally dislodged from the receptacle.

In one particular embodiment, a thickness 40 of the inner layer 36 of the belt 10 is at least as thick as the key 14. By providing a thickness 40 of the inner layer 36 at least as thick as the key 14, the key 14 is recessed into the cutout 22 and is less likely to be snagged when the person puts on the belt 10 or takes it off. This further reduces the possibility that the key could be accidentally dislodged from the receptacle 12.

In order to remove the key 14 from the receptacle 12, the belt 10 is simply bent or otherwise caused to curve in the opposite direction to that shown in FIG. 2. This may be done by releasing a buckle of the belt 10 and bending the belt and receptacle 12 in the opposite direction or by twisting the belt while being worn by the person so that the inner surface 36 faces outwards.

Figure 3:
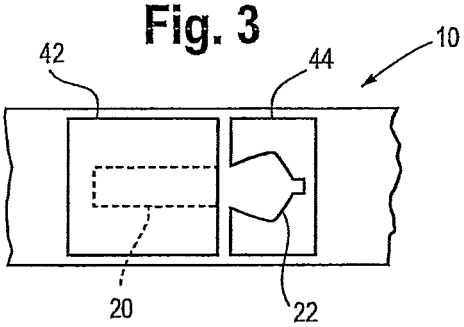
FIG. 3 is a rear view of the belt of FIG. 1 under an alternate embodiment.

In another embodiment, the receptacle 12 may be defined by one or more patches 42, 44 as shown in FIG. 3. In this case, a first patch 42 comprises a first panel that may be sewn to or otherwise attached to the belt 10 in such a way as to provide a pocket 20. Similarly, a second patch or panel 44 with the cutout 22 may be disposed directly adjacent the first patch 42. As above, placing the belt 10 of FIG. 3 around the waist of the person causes the opening of the pocket 20 to pull the head of the key into the cutout thereby preventing the accidental loss of the key 14.

In general, the belt 10 may be made of leather, canvas or any other appropriate material. In the case where the belt is made of a single layer of leather, then the pocket and cutout may be fabricated of a second layer of canvas or leather sewn to the belt. In the case where the second layer is of canvas or other woven material, stitching may be provided around the opening and cutout to prevent fraying.

Under one illustrated embodiment, the belt has a longitudinal axis configured to encompass the waist of a person, a longitudinal pocket formed in the belt, the longitudinal pocket having an opening on one end and the pocket extending from the opening along the longitudinal axis of the pocket parallel to the longitudinal axis of the belt to a second closed end and a cutout in the material of the belt adjacent an opening to the pocket, the cutout receives the handle of a key inserted into the pocket, the curvature of the belt around the person causing the material around the opening to the pocket to pull the head of the key into the cutout thereby preventing the key from being accidentally dislodged from the pocket.

Under another illustrated embodiment, the belt has a longitudinal axis configured to encompass the waist of a person, a first panel attached to the belt, the first panel containing a longitudinal pocket extending from an opening to the pocket parallel to the longitudinal axis of the belt to a blind end of the pocket and a second panel adjacent an opening to the pocket, the second pocket having a cutout that receives the handle of a key inserted into the pocket, the curvature of the belt around the person causing the material of the second panel around the opening to the pocket to pull the head of the key into the cutout thereby preventing the key from being accidentally dislodged from the pocket.

Under still another illustrated embodiment, the belt has a longitudinal axis configured to encompass the waist of a person, a patch disposed on the belt, the patch extending across a width of the belt on a side of the belt facing the person, the patch forming a longitudinal pocket for a key between the patch and belt where an opening of the pocket receives the actuator end of the key, the longitudinal pocket oriented to receive the key parallel to the longitudinal axis of the belt and a cutout in the patch extending outwards from the opening and from the pocket along the longitudinal axis, the cutout traces the outline of the handle of the key wherein a curvature of the belt during normal use by the person causes the portion of the patch surrounding the opening to pull the handle of the key into the cutout against the belt thereby preventing the key from being accidentally dislodged from the pocket.

Although a few embodiments have been described in detail above, other modifications are possible. For example, the logic flows depicted in the figures do not require the particular order shown, or sequential order, to achieve desirable results. Other steps may be provided, or steps may be eliminated, from the described flows, and other components may be added to, or removed from, the described systems. Other embodiments may be within the scope of the following claims.

The invention claimed is:

1. An apparatus comprising:

a belt having a longitudinal axis that encompasses the waist of a person;

a first panel attached to the belt, the first panel containing substantially a longitudinal pocket extending from an opening into the pocket parallel to the longitudinal axis of the belt to a blind end of the pocket; and a second panel adjacent the opening into the pocket, the second pocket panel having a cutout that remains open against the waist of the person during use and that receives the handle of a key inserted into the pocket, the curvature of the belt around the person causing the material of the second panel around the opening to the pocket to pull the head of the key into the cutout thereby preventing the key from being accidentally dislodged from the pocket.

2. The apparatus as in claim 1 wherein the belt further comprises a first layer and wherein the first and second panels further comprise different portions of a second layer.

3. The apparatus as in claim 2 wherein the first and second layers further comprise leather.

4. The apparatus as in claim 2 wherein one of the first and second layers further comprises a woven material.

5. The apparatus as in claim 4 wherein the woven material of the one of the first and second layers comprises canvas.

6. The apparatus as in claim 1 wherein the second panel further comprises a thickness extending around the cutout that exceeds a thickness of the key so that the key does not snag.

7. The apparatus as in claim 1 wherein the pocket, the opening and cutout further comprise respective lengths and widths that are slightly larger than a handcuff key.

8. An apparatus comprising:

a belt having a longitudinal axis and length configured to encompass the waist of a person;

a substantially longitudinal pocket formed in the belt, the longitudinal pocket having an opening on one end and the pocket extending from the opening along the longitudinal axis of the pocket parallel to the longitudinal axis of the belt to a second closed end; and a cutout in the material of the belt adjacent to and extending away from the pocket and an opening to the pocket, the cutout receives the handle of a key inserted into the pocket and remains open against the waist of the person during use, the curvature of the belt around the person causing the material around the opening to the pocket to pull the head of the key into the cutout thereby preventing the key from being accidentally dislodged from the pocket.

9. The apparatus as in claim 8 wherein the material of the belt comprises one of leather and canvas.

10. The apparatus as in claim 8 wherein the belt further comprises first and second layers of leather with the pocket formed between the first and second layers and the cutout formed in the surface of the one of the first and second layers of the belt that faces the waist of the person.

11. The apparatus as in claim 8 wherein the belt further comprises first and second layers with one of the first and second layers formed of a woven material with the pocket formed between the first and second layers and the cutout formed in the surface of the belt that faces the waist of the person.

12. The apparatus as in claim 8 further comprises a patch sewn to the belt wherein the longitudinal pocket is defined by the patch sewn to the belt.

13. The apparatus as in claim 8 further comprise first and second panels sewn to the belt wherein the longitudinal pocket and cutout are defined by the first and second panels.

14. The apparatus as in claim 13 further comprising stitching around the opening and cutout that prevents fraying of the first and second panels.

15. The apparatus as in claim 13 further comprising a thickness of a material of the belt surrounding the cutout at least equal to a thickness of the key.

16. The apparatus as in claim 15 wherein the key further comprises a handcuff key.

* * * * *